US008191645B2

(12) United States Patent
Carisella et al.

(10) Patent No.: US 8,191,645 B2
(45) Date of Patent: Jun. 5, 2012

(54) SUBTERRANEAN WELL TOOL INCLUDING A LOCKING SEAL HEALING SYSTEM

(75) Inventors: James V. Carisella, New Orleans, LA (US); Kevin Morrill, Madisonville, LA (US)

(73) Assignee: High Pressure Integrity, Inc., Harahan, LA (US)

( * ) Notice: Subject to any disclaimer, the term of this patent is extended or adjusted under 35 U.S.C. 154(b) by 0 days.

(21) Appl. No.: 12/861,452

(22) Filed: Aug. 23, 2010

(65) Prior Publication Data

US 2010/0314135 A1 Dec. 16, 2010

Related U.S. Application Data

(62) Division of application No. 11/679,302, filed on Feb. 27, 2007, now Pat. No. 7,779,905.

(51) Int. Cl.
*E21B 23/06* (2006.01)

(52) U.S. Cl. ..... 166/387; 166/123; 166/125

(58) Field of Classification Search ..... 166/123, 166/125, 182, 387
See application file for complete search history.

(56) References Cited

U.S. PATENT DOCUMENTS

| | | | | |
|---|---|---|---|---|
| 2,742,968 | A | 4/1956 | Hildebrandt | |
| 3,011,555 | A | 12/1961 | Clark, Jr. | |
| 3,221,818 | A * | 12/1965 | Bostock et al. | 277/338 |
| 3,339,637 | A | 9/1967 | Holden | |
| 3,459,261 | A * | 8/1969 | Cochran | 166/120 |
| 3,587,736 | A | 6/1971 | Brown | |
| 3,603,390 | A | 9/1971 | McGill | |
| 3,702,634 | A | 11/1972 | Anderson et al. | |
| 3,706,342 | A | 12/1972 | Woolley | |
| 3,872,295 | A | 3/1975 | Clancy | |
| 4,044,826 | A | 8/1977 | Crowe | |
| 4,224,987 | A | 9/1980 | Allen | |
| 4,438,933 | A | 3/1984 | Zimmerman | |
| 4,518,037 | A * | 5/1985 | Youngblood et al. | 166/125 |

(Continued)

FOREIGN PATENT DOCUMENTS

GB 2309988 8/1997

(Continued)

OTHER PUBLICATIONS

Georgescu, Mihnea, Partial European Search Report, Jun. 13, 2008, 2 pages, European Patent Office, Munich.

(Continued)

*Primary Examiner* — William P Neuder
(74) *Attorney, Agent, or Firm* — Mark A. Oathout; Oathout Law Firm

(57) ABSTRACT

A well tool with multi-stage remedial system improves the durability of a subterranean well tool having an expanded elastomeric member, such as a packer, for use inside a tubular member. The well tool with multi-stage remedial system has a plurality of mandrel members shiftable within the tubular member for anchoring and for setting the seal system. A floating tandem mounted annularly around the lower mandrel members has one end (upon shifting) proximate an end of the seal system, and the floating tandem has an opening to ambient bottom-hole-pressure of the subterranean well. A locking tandem is interposed with the floating tandem and at least one of the lower mandrel members. The floating tandem and the locking tandem together assist in abating elastomeric member extrusion under high temperature, high pressure environments as well as other conditions lending to failure within the well.

15 Claims, 11 Drawing Sheets

U.S. PATENT DOCUMENTS

| | | | | |
|---|---|---|---|---|
| 4,554,973 | A | 11/1985 | Shonrock et al. | |
| 4,924,941 | A | 5/1990 | Farley | |
| 5,010,958 | A | 4/1991 | Meek et al. | |
| 5,058,673 | A | 10/1991 | Muller et al. | |
| 5,146,983 | A | 9/1992 | Hromas et al. | |
| 5,560,426 | A * | 10/1996 | Trahan et al. | 166/120 |
| 5,810,082 | A | 9/1998 | Jordan, Jr. | |
| 6,311,778 | B1 | 11/2001 | Carisella et al. | |
| 6,318,461 | B1 | 11/2001 | Carisella | |
| 6,354,372 | B1 | 3/2002 | Carisella et al. | |
| 6,823,945 | B2 | 11/2004 | Eslinger et al. | |
| 6,902,008 | B2 | 6/2005 | Hirth et al. | |
| RE38,866 | E | 11/2005 | Myhre | |
| 7,172,029 | B2 | 2/2007 | Hirth et al. | |
| 7,455,118 | B2 | 11/2008 | Roberts et al. | |
| 7,552,777 | B2 | 6/2009 | Murray et al. | |
| 7,779,908 | B2 * | 8/2010 | Eriksson et al. | 166/196 |
| 2003/0019623 | A1 | 1/2003 | King et al. | |

FOREIGN PATENT DOCUMENTS

| | | |
|---|---|---|
| GB | 2315507 | 2/1998 |
| WO | WO 00/63522 | 10/2000 |
| WO | WO 03/054345 | 7/2003 |

OTHER PUBLICATIONS

Georgescu, Mihnea, European Search Report, Jan. 12, 2009, 7 pages, EPO, Munich, Europe.

Georgescu, Mihnea, Partial European Search Report, Jan. 20, 2011,pp. 1-2 , EPO, Munich, Europe.

Georgescu, Mihnea, Lack of Unity of Invention Sheet B, Jan. 20, 2011, pp. 1-2, EPO, Munich, Europe.

Georgescu, Mihnea, European Search Report and Lack of Unity of Invention Sheet B; Apr. 18, 2011, pp. 1-9, EPO, Munich, Europe.

Georgescu, Mihnea, European Search Report, Jan. 25, 2011, pp. 1-5, EPO, Munich, Europe.

* cited by examiner

SUBTERRANEAN WELL TOOL INCLUDING A LOCKING SEAL HEALING SYSTEM

CROSS-REFERENCE TO RELATED APPLICATIONS

This application is a divisional of U.S. patent application Ser. No. 11/679,302, filed Feb. 27, 2007 now U.S. Pat. No. 7,779,905.

STATEMENTS REGARDING FEDERALLY SPONSORED RESEARCH OR DEVELOPMENT

Not applicable.

REFERENCE TO A MICROFICHE APPENDIX

Not applicable.

BACKGROUND OF THE INVENTION

During the drilling, completion or work over of a subterranean well, it is frequently necessary to isolate one or more zones or sections of the well for various purposes. A permanent or retrievable well plug, such as a packer, bridge plug, tubing hanger assembly, positive-sealing-plugs or the like, will include an elastomer member for sealing across an interior area in tubular member or other well bore tubular previously set within the well. The elastomer member of such devices is expandable from a retracted position during run-in through the casing or opens whole on a conduit member, such as tubing, wire line or electric line, and is activated to seal within the well bore or tubular member through expansion.

The elastomeric member of the well plug may be a series of rubber-like solid seal elements which are squeezed or compressed into sealing engagement with the well tubular member by a compressive force generated or transmitted through the well tool.

After the compressive force has been applied for considerable time through such elastomer, anelastic behavior through the elastomer may occur. The industry widely uses cement retainers as a response to this behavior. Some such well plugs require up to 16,000 lbs. of force, or more, directed through the device to impart a compressive stress in the elastomer which causes it to form the necessary hydraulic seal in the well. During the application of such high compressive forces, such elastomers are less likely to remain static, but ooze and squeeze or otherwise result in an anelastic (time-dependent deformation) behavior which can be referred to as creep and stress-relaxation, whilst the third stage of creep has an accelerating creep rate and terminates by failure of material at time for rupture. The anelastic behavior of materials are amplified by conditions of increased temperature, changing temperature, increased pressure, saturation of water, water invading seal elements and/or invading gases.

BRIEF SUMMARY OF THE INVENTION

The ability to provide a mechanism to abate and reduce anelastic behavior and the oozing of the seals under pressure is called "healing" and a system or mechanism for abating such phenomenon is called a "healing system".

A subterranean well tool, such as a packer, bridge plug, or the like, in which the tool has a sealing system generally includes an elastomeric seal means together with extrusion rings, barriers, or the like at each end of the seal element. These anti-extrusion elements are intended to prevent the elastomeric member from extruding out of original sealing position relative to a conduit, such as tubular member, during setting, as well as a result of exposure to extreme high temperatures and/or pressures, together with the effects of time, on the seal means. The anti-extrusion features become more significant for high expansion, high differential pressure plug systems.

A well tool with a multi-stage remedial system may be used within a subterranean well and improves the durability of a subterranean well tool having an expanded elastomeric member, such as a packer, for use inside a tubular member (a first conduit string, such as a drill string, production or work over string, electric or wire line, or the like). The well tool with multi-stage remedial system has a plurality of mandrel members shiftable within the tubular member for anchoring and for setting the seal system. A floating tandem mounted annularly around the lower mandrel members has one end (upon shifting) proximate an end of the seal system and the floating tandem has an opening to ambient bottom-hole-pressure of the subterranean well. A locking tandem is interposed with the floating tandem and at least one of the lower mandrel members. The floating tandem and the locking tandem together assist in abating elastomeric member extrusion under high temperature, high pressure environments as well as other conditions lending to failure within the well.

DESCRIPTION OF THE PREFERRED EMBODIMENT(S)

Figure 1A:
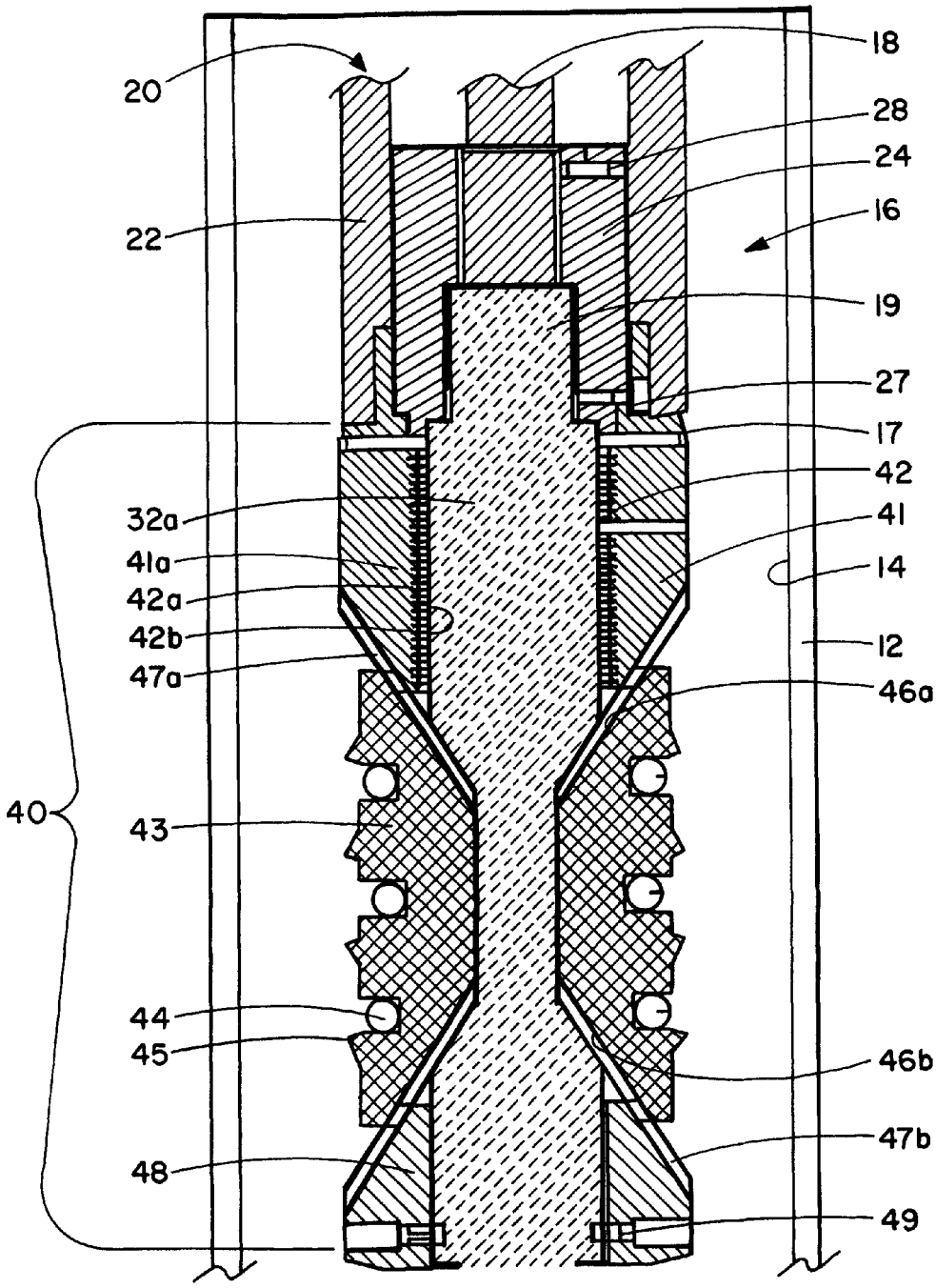
FIGS. 1A, 1B, and 1C together constitute an elongated cross sectional view of one embodiment of the tool and remedial system as it is run into the well.
Figure 1B:
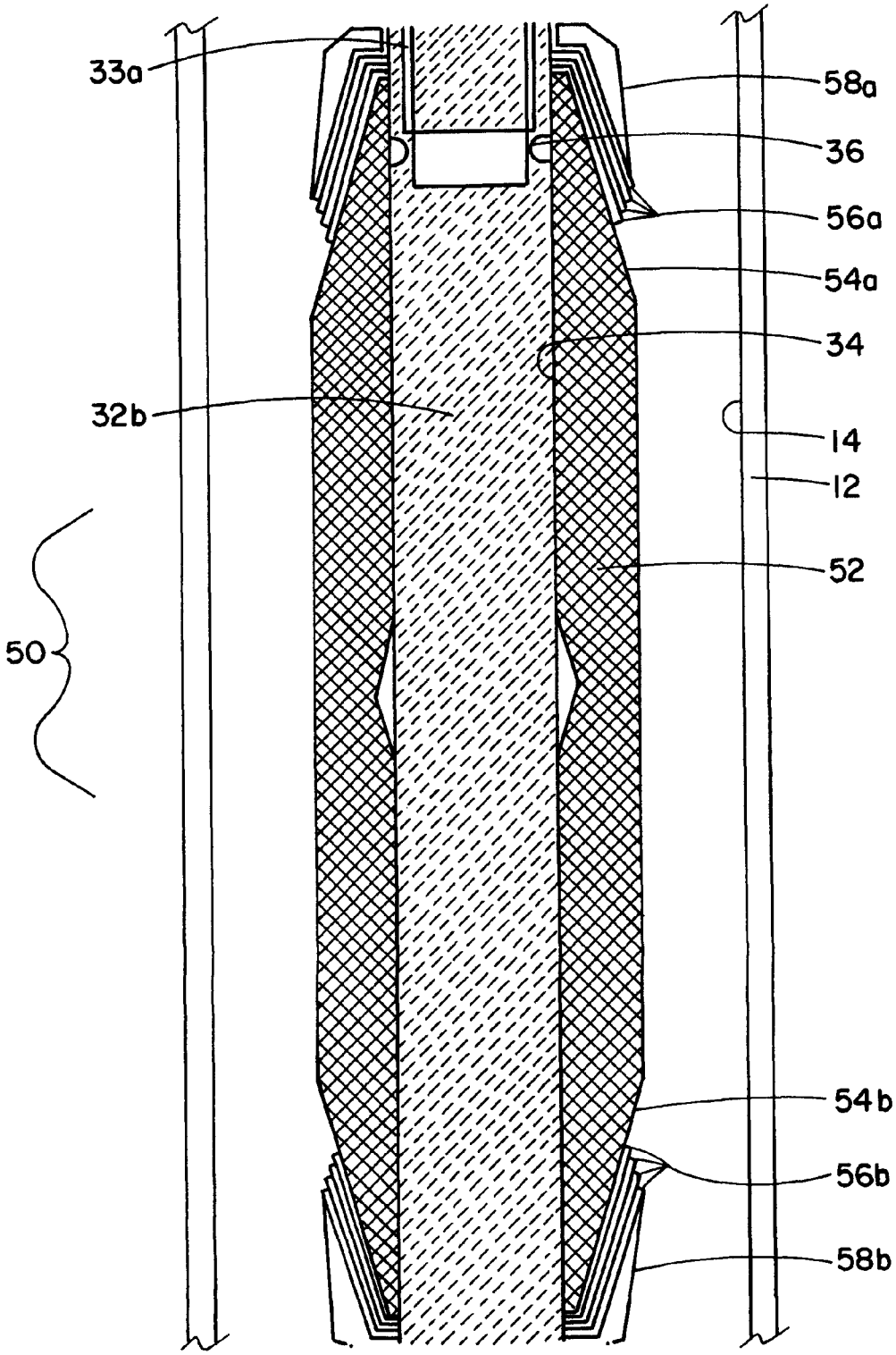
Figure 1C:
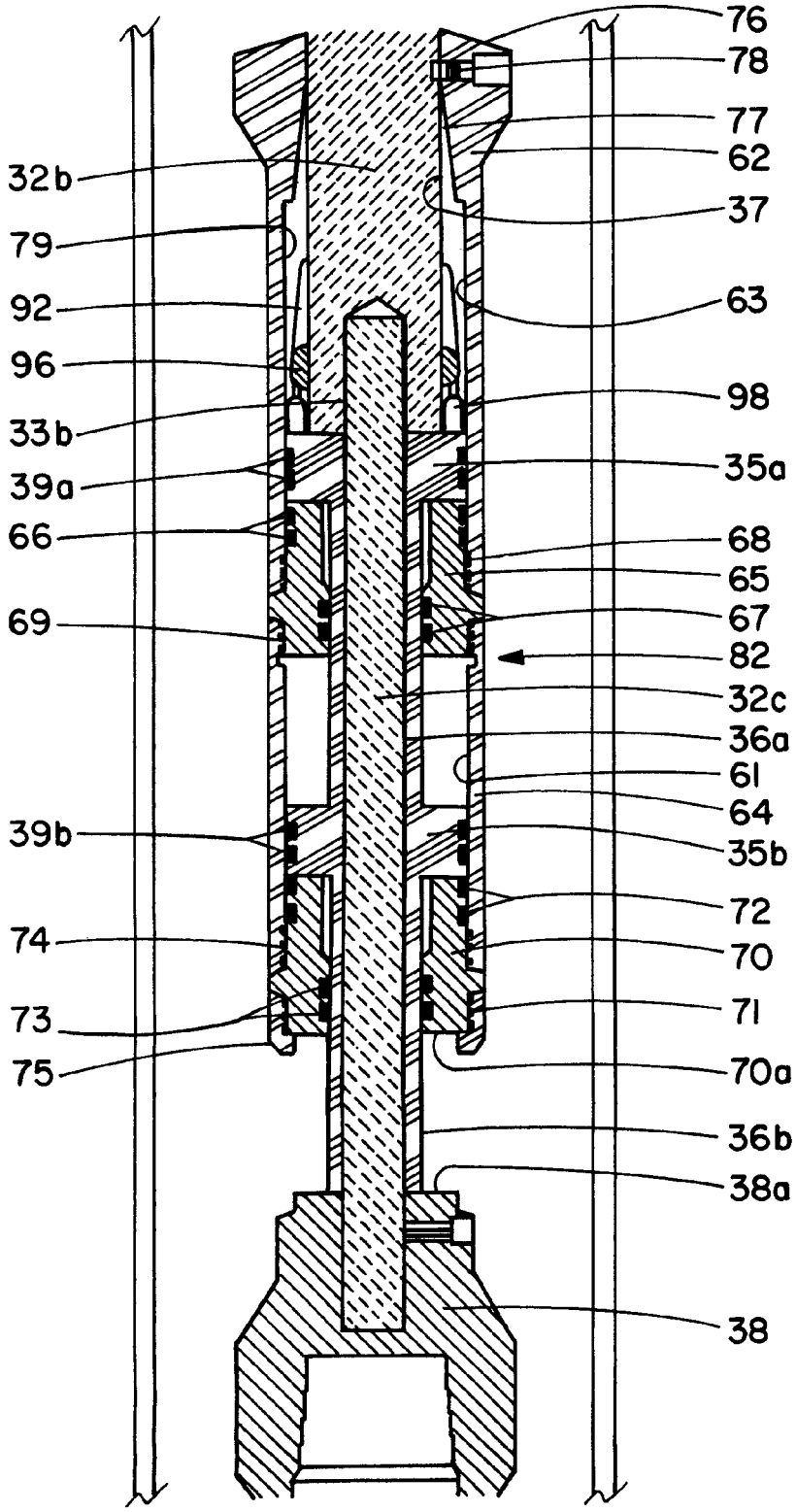

Now referring to FIGS. 1A, 1B and 1C, the well tool with multi-stage remedial system 10 (referred to herein as "tool and remedial system 10") used with a well plug or inflatable 11 is shown in run-in position within a tubular member or a casing conduit string 12 having an interior wall (normally smooth) 14. The tool and remedial system 10 is run into the well 16 and connected at its upper most end on a setting tool adapter rod 18 of a setting tool 20 which includes adapter sleeve 22. The setting tool 20 is, in turn, carried into the well 16 on a well conduit (not shown) such as a conventional work string, a tubing string, wire line, electric cable, or the like.

The axial direction of the well 16 may be vertical, horizontal, or oblique (and may also be arcuate). The embodiments discussed herein will perform in each of these directions/environments and the drawings are intended to reflect each and every of the aforementioned directions (although the drawings may appear to represent only the vertical).

Referring to FIGS. 2-6, the tool and remedial system 10 generally has a rigid through tandem 30 (FIG. 4) running primarily through the center of the tool and remedial system 10, a floating tandem 60 (FIG. 5) located near the lower end along the periphery of the rigid-through tandem 30, and a locking tandem 90 (FIG. 6) located external to the rigid-through tandem 30 and internal to the floating tandem 60.

Again generally but to be described in further detail below, the rigid-through tandem 30 supports (and includes upon deployment) an anchor assembly 40 and also supports a seal system 50. Upon deployment, the anchor assembly 40, the seal system 50, and the floating tandem 60 (initially via mechanical force) are operative for applying an elastomeric member 52 across the interior of the tubular member 12, whilst the floating tandem 60 functions as a mechanical driver to continue (over time) to urge the elastomeric member 52 around the interior of the tubular member (against interior wall 14). In other words the compressive force on the elastomeric member 52 causes a seal by forcing the elastomeric member 52 to span and engage the inner diameter (interior wall 14) of the tubular member 12.

The locking tandem 90 is employed in the system because the compressive force mentioned in the preceding paragraph must be sufficiently maintained under a variety of conditions in order to continue to effectuate the seal over time and more particularly under extreme operating conditions. Further, it must be maintained in a multi-directional manner meaning that changes in differential pressures, temperatures, deformities, fluid invasions (in the tubular member 12) and/or forces originating, for example, from the up-hole side 16*a* of the system as well as other directions such as but not limited to downhole must be accommodated in the system. By way of example, a sufficient force from the up-hole side 16*a* could cause a momentary lapse, hindward motion or retreat in the floating tandem 60 (especially during anelastic behavior of the seals) such that the compressive force is momentarily released or slackened affording the opportunity for a change in the nature of the seal (see the following paragraph in this regard). The locking tandem 90 functions to maintain the compressive force by preventing hindward motion or retreat of the floating tandem 60 (i.e. it maintains rigidity in the system). In the embodiment shown the locking tandem 90 accomplishes this function by wedging between the rigid-through tandem 30 and the floating tandem 60 and by allowing motion in only one direction (via ratcheting). The compressed energy therefore becomes trapped in the elastomeric member 52 as a seal engaged in the inner diameter (interior wall 14) of the tubular member 12 causing a continued seal/plug in the tubular member 12 (whereas the elastomeric member 52 prefers to be in its lowest state of energy and therefore tends toward anelastic deformation to relieve or reduce the trapped energy).

Notably without maintaining the compressed energy in the elastomeric member 52, the elastomeric member 52 will eventually creep or extrude through a gap (not shown) between upper and lower metallic anti-extrusion envelope systems 59*a* and 59*b* and the interior wall 14. In addition, the elastomeric member 52 without sufficiently maintained compression can fail due to stress relaxation in the region of extrusion. These events lead to failure in the system.

It should be mentioned in passing at this juncture that the floating tandem 60 may be urged against the seal system 50 mechanically, using differential pressure, by spring, or by any other known urging means, either individually or in combination. The urging will come in the axial direction of the tubular member 12 from the down-hole side 16*b* of the interior of the tubular member 12 in the normal case.

Now by way of greater detail in the embodiment shown by referring back to FIGS. 1A, 1B and 1C, the setting tool 20 carries the tool and remedial system 10 at its lower end. The tool and remedial system 10 includes a series of aligned mandrels 32*a*, 32*b*, 32*c* all of which are initially engaged together in series. The setting tool 20 is secured to the mandrel 32*a* by means of lock pin 27 disposed through a bore in an adaptor bushing 24. A companion screw or pin 28 is placed laterally at the upper end of the adaptor bushing 24 within a bore for securing the adaptor bushing 24 to the setting tool adapter rod 18.

Figure 4:
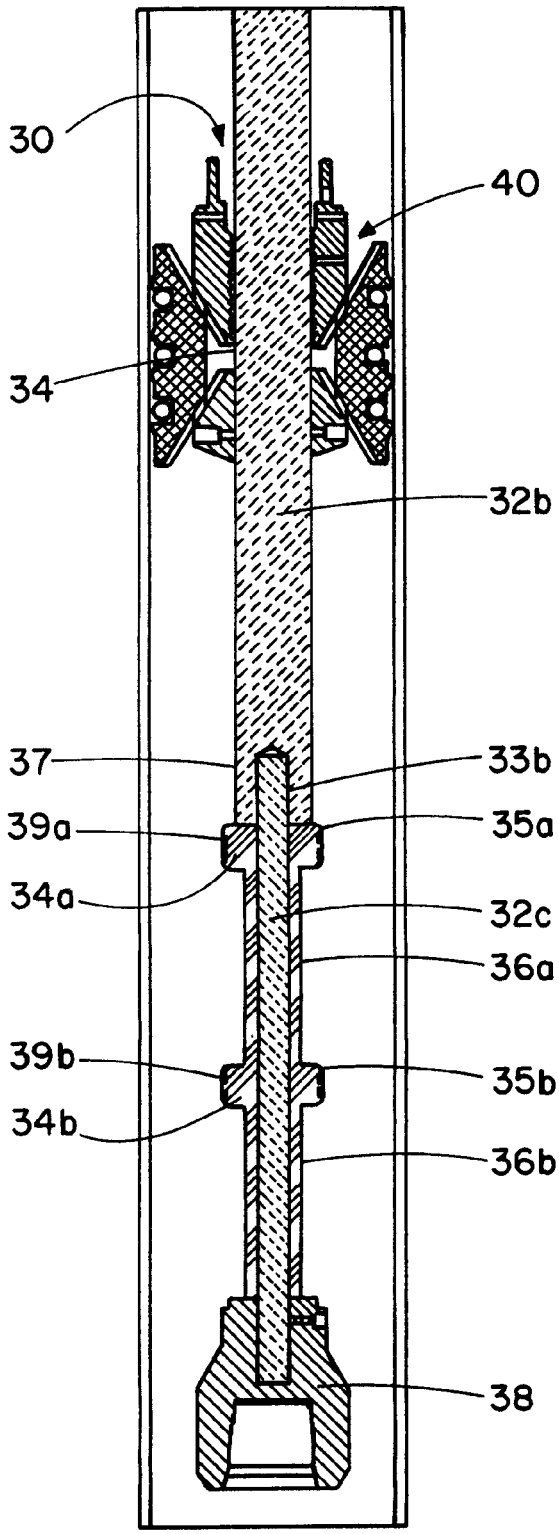
FIG. 4 is a sectional view of one embodiment of the rigid-through tandem 30.
Figure 5:
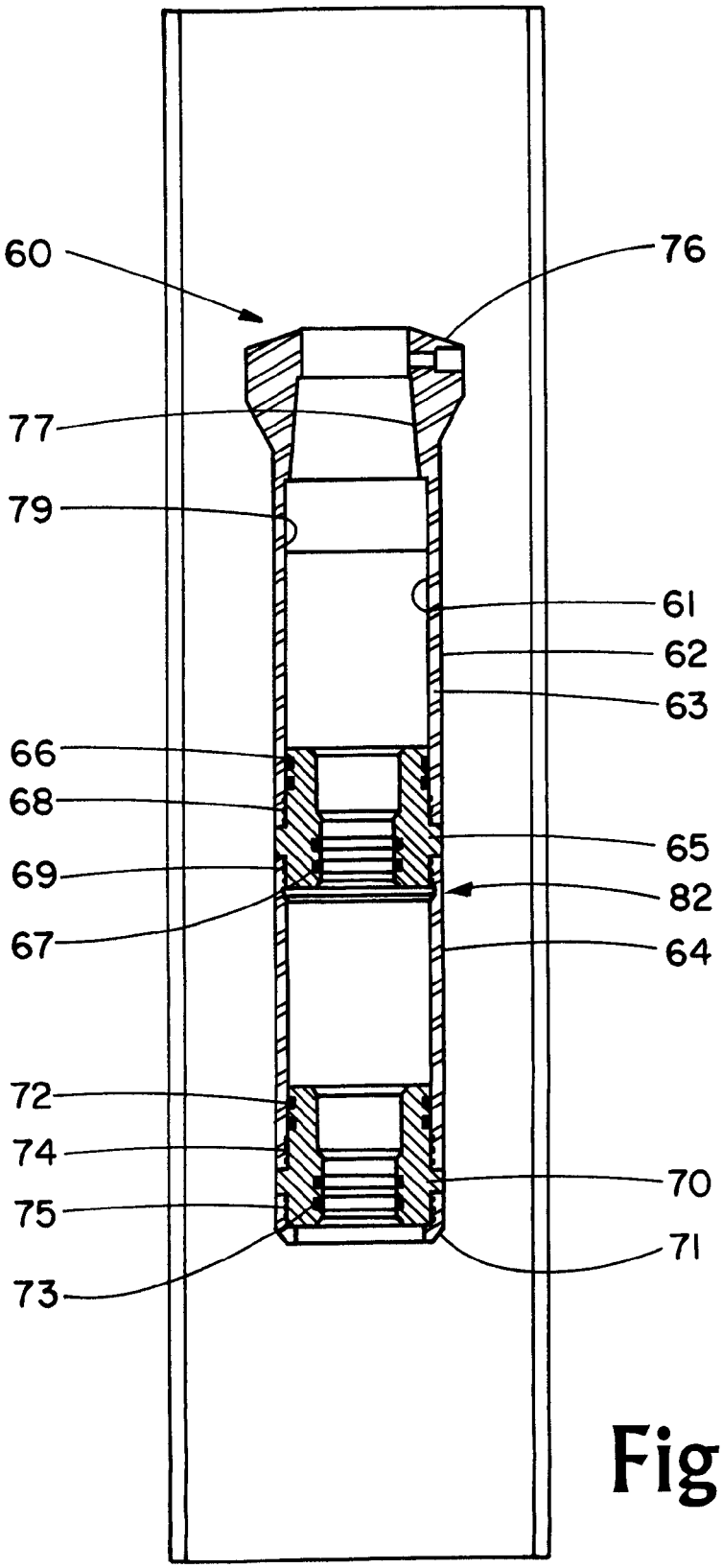
FIG. 5 is a sectional view of one embodiment of the floating tandem 60.

In viewing FIGS. 1A, 1B, and 1C, it will be appreciated that the series of aligned mandrels 32*a*, 32*b*, 32*c* together extend through the anchor assembly 40, the seal system 50, the floating tandem 60, and the locking tandem 90, whilst the mandrels 32*b* and 32*c* form part of the rigid-through tandem 30 (FIG. 4). The mandrel 32*a* and the mandrel member 32*b* connect via threading at 33*a* engaging between the lower end of mandrel 32*a* and the upper end of mandrel 32*b*. Mandrel member 32*c* is connected via threading at 33*b* between the lower end of the mandrel member 32*b* and the upper end of member mandrel 32*c*, and accordingly, is responsive to movements of such shifting mandrel members.

The anchor assembly 40 includes at its upper most end a wedging backup lock ring 41 which houses a lock ring member 42. Externally the lock ring member 42 has a set of angularly profiled locking teeth 42*a* that lock with the locking teeth 41 a internal to wedging backup lock ring 41. Internally the lock ring member 62 has a series of ratcheting teeth 42*b* which are permitted to ride upon (when moved into position) companion ratcheting teeth 34 carried exteriorly around the mandrel member 32*b*.

The anchor assembly 40 also includes a series of radially bi-directional slips 43 secured or banded around the mandrel member 32*a* by a plurality of gasket rings 44 (three shown in the embodiment of FIG. 1A).

Figure 2:
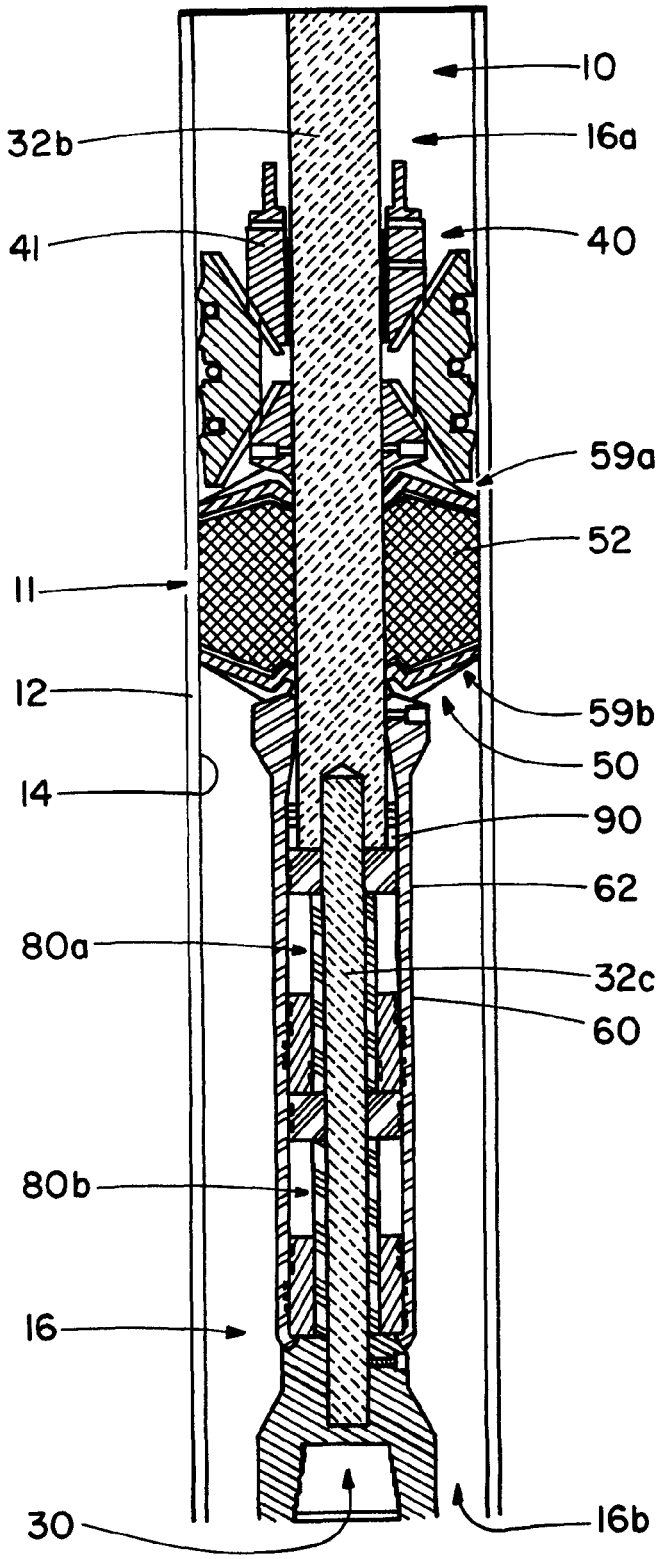
FIG. 2 is a view similar to the combined FIGS. 1A, 1B and 1C illustrating the tool and remedial system being set to anchor the tool and application of the seal system to a sealing position against the well conduit or tubular member (locking tandem not yet engaged).

Each of the bi-directional slips 43 have sharp wicker tips 45 thereon for grasping the interior wall 14 of the casing 12, as the tool and remedial system 10 is moved to anchoring position (represented in FIG. 2).

Each of the bi-directional slip(s) 43 have upper 46*a* and lower wedging faces 46*b*. The upper 46*a* and lower wedging faces 46*b* are provided for slideably mating engagement and movements outwardly (when moving from unanchored to anchored position) along companion profiled surfaces 47*a* and 47*b* of the respective wedging backup lock ring 41 and lower wedging cone 48. The lower wedging cone 48 is initially secured to the mandrel member 32*a* by sheer screws 49.

Now with reference to FIG. 1B, the seal system 50 will be discussed. As shown in FIG. 1B, the mandrel member 32*b* is primarily disposed within the interior of the seal system 50 when the tool and remedial system 10 is in the run-in position.

The seal system 50 includes an elastomeric member 52 of a nature that is well known to those skilled in the art. In its broadest sense, the seal system 50 includes the elastomeric member 52 having upper and lower ends (tapered inward toward the distal ends) 54*a* and 54*b*. The upper and lower ends 54*a* and 54*b* each respectively receive a series of upper and lower inner metal backup members 56*a* and 56*b* which are respectively sandwiched between an upper outer metal backup member 58*a* and a lower outer backup member 58*b*. When the seal system 50 is deployed (FIG. 2) the series of upper metal backup members 56*a* together with the upper outer metal backup member 58*a* form an upper metallic anti-extrusion envelope system 59*a*. When the seal system 50 is deployed (FIG. 2) the series of lower metal backup members 56*b* together with the lower outer metal backup member 58*b* form a lower metallic anti-extrusion envelope system 59*b*, while differing ambient wellbore pressure conditions can exist both above and below the seal system 50.

When the tool and remedial system 10 is activated by manipulation of the setting tool 20 the mandrel members 32*a* and 32*b* are pulled in one direction, such as upwardly, and the anchoring assembly 40 is shifted outwardly such that sharp wicker tips 45 with bi-directional slips 43 grasp and bite into and anchor along the interior wall 14 of the casing 12 at the desired setting depth. The elastomeric member 52 is then caused to be contracted in length and radially expands outwardly to seal against the interior wall 14, and the upper and lower metal backup members 54*a* and 54*b* are positioned relative to the casing wall 14 as shown in FIG. 2.

Figure 3:
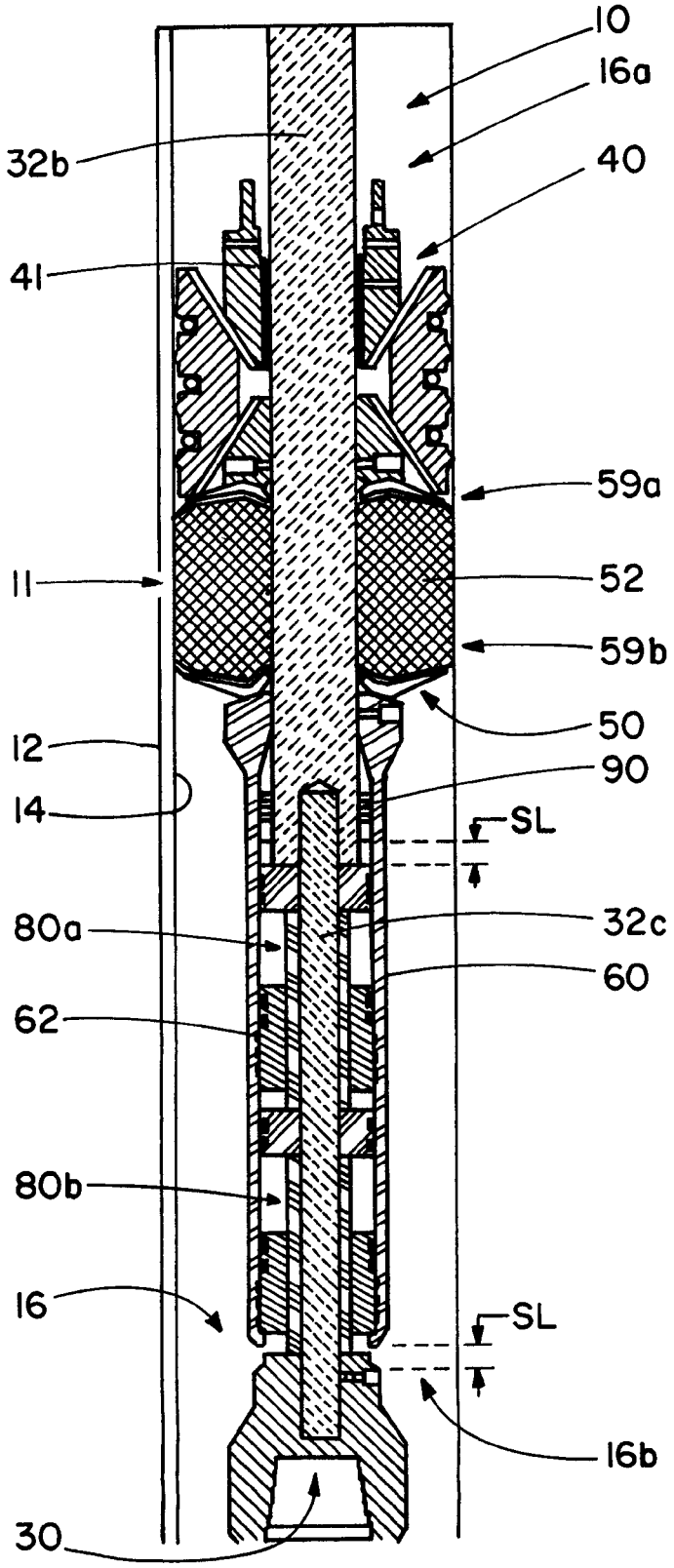
FIG. 3 is a view, similar to FIG. 2, illustrating the tool and remedial system with the floating tandem and locking tandem activated in response to hydrostatic well pressure at the tool setting depth.
Figure 6:
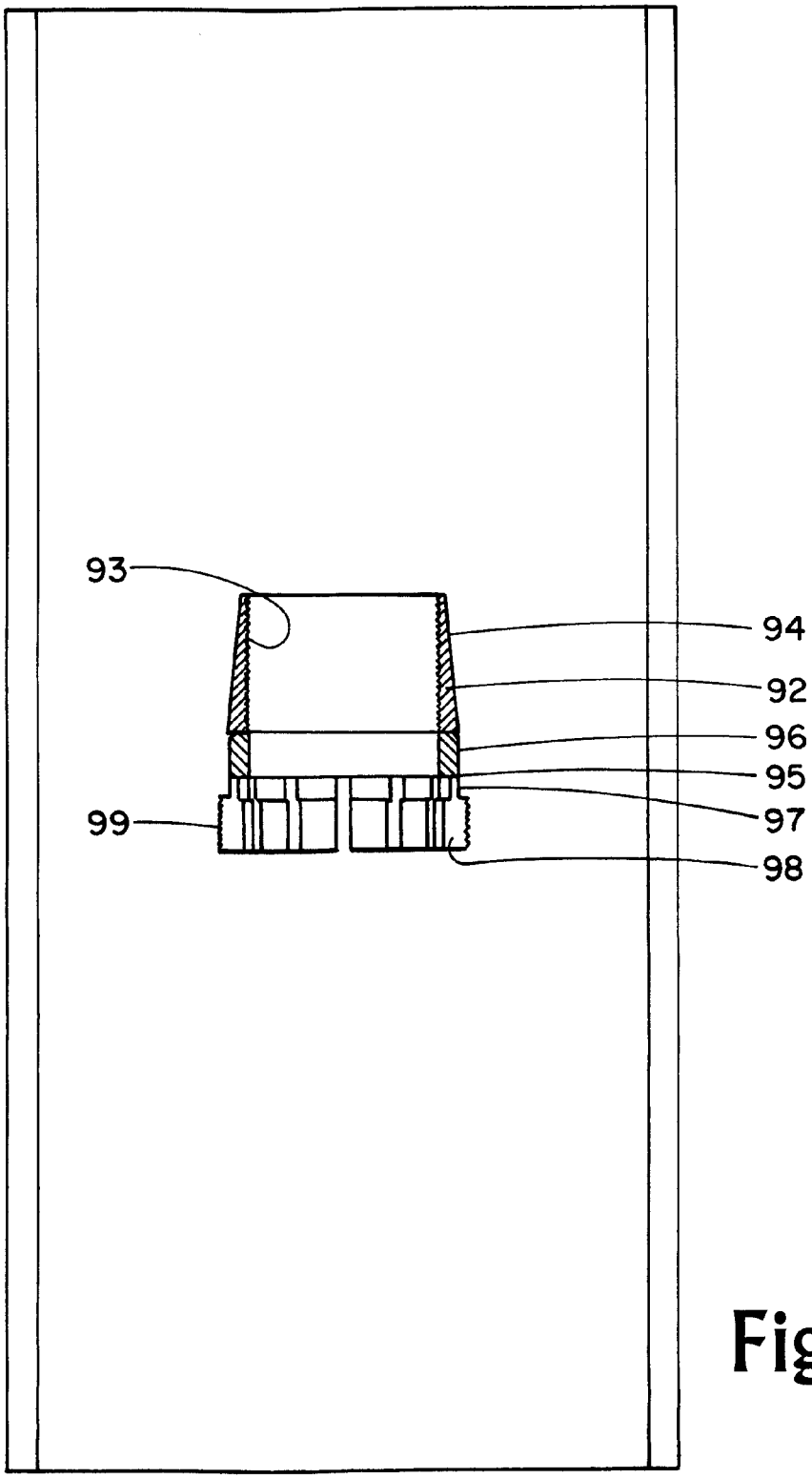
FIG. 6 is a sectional view of one embodiment of the locking tandem 90.

Now with reference to FIGS. 1C, 2 and 3, the lower portion of the tool and remedial system 10 will be discussed including the rigid-through tandem 30 (lower portion) (FIG. 4), the floating tandem 60 (FIG. 5) and the locking tandem 90 (FIG. 6).

As to rigid-through tandem 30, the mandrel member 32*c* is secured via threading 33*b* to the lower most end of the mandrel member 32*b*. At least one piston head and rod assembly 34*a* having a piston head 35*a* and an extended rod segment 36*a* are carried around the mandrel member 32*c*. In the embodiment(s) shown, there is a second piston head and rod assembly 34*b* including as piston head 35*b* and an extended rod segment 36*b* carried around the mandrel member 32*c*. The top of piston head 35*b* abuts the bottom of extended rod segment 36*a*. The top of piston head 35*a* abuts the bottom of mandrel member 32*b*. Bull nose 38 is connected at the lower end of mandrel member 32*c*. The upper end of bull nose 38 abuts the lower end of extended rod segment 36*b*. When the anchor assembly 40 is anchored the various elements of the entire rigid-through tandem 30 as represented in FIG. 4 together become a unified rigid tandem of members, hence the term "rigid-through tandem" 30.

Each of the piston head and rod assemblies 34*a* and 34*b* include a respective series of piston head seals 39*a* and 39*b* which seal against, but are permitted to slide along, as hereinafter described, a smooth interior surface 61 of a translating cylinder 62. The translating cylinder 62 and hence the floating tandem 60 is initially secured to the mandrel member 32*b* by means of shear screw 63.

The floating tandem 60 generally includes the translating cylinder 62 and the translating drivers 65 and 70. The translating cylinder 62 has an upper translating cylinder component 63, a lower translating cylinder component 64 and a cylinder end ring 71. Lodged between the upper and lower translating cylinder components 63 and 64 is the translating driver 65 having a set of static seals 66 sealing against the interior surface 61 of the translating cylinder 62. The translating driver 65 also contains piston rod seals 67 facing to the interior and sealing against the extended rod segment 36*a*. The translating driver 65 is secured to the upper and lower translating cylinder components 63 and 64, respectively, via threading engagements 68 and 69.

Lodged between the lower translating cylinder component 64 and cylinder end ring 71 is a translating driver 70. The translating driver 70 has a set of static seals 72 sealing against the interior surface 61 of the translating cylinder 62. The translating driver 70 also contains piston rod seals 73 facing to the interior and sealing against the extended rod segment 36*b*. The translating driver 70 is secured to the lower translating cylinder component 64 and the cylinder end ring 71, respectively, via threading engagements 74 and 75.

After the rigid tandem 30 is pulled relative to the floating tandem 60, vacuum chambers 80*a* and 80*b* (or regions of relatively lower pressure), see FIG. 2, are created between the each of the piston heads 35*a* and 35*b* and respective translating drivers 65 and 70 (between translating cylinder 62 and respective extended rod segments 36*a* and 36*b*) as further described below.

After the seal system 50 is set the floating tandem 60 urges against the seal system 50 and can move over time relative to the rigid tandem 30. The relative movement between the floating tandem 60 and the rigid tandem 30 may be defined as a stroke length SL. The stroke length SL may be represented by contrasting the change in position of floating tandem 60 relative to rigid tandem 30 between FIG. 2 (where the stroke translated from hydrostatic bore pressure has not yet initiated or achieved any noticeable length) and FIG. 3. The potential length of the healing stroke (or take-up stroke distance) SL is variable in length depending upon the parameters of a given application, and the actual stroke length SL in a given application is time dependent upon seal extrusion and the like.

The translating cylinder 62 further includes a ram surface 76 at its upper most end.

When the translating cylinder 62 is shifted upwardly by movement of the mandrel member 32*c* in concert with adjoining mandrel member 32*b* and mandrel member 32*a* as a result of shifting the setting tool 20 in one direction, the ram surface 76 of the translating cylinder 62 will contact the lower outer backup member 58*b*. Since the anchor assembly 40 of the tool and remedial system 10 previously has been moved outwardly into anchoring engagement with the interior wall 14 of the tubular member 12, continued upper movement of the tool and remedial system 10 relative to the mandrel members 32*c*, 32*b* and 32*a* is resisted and the movement of the mandrel members 32*a*, 32*b* and 32*c* will cause compression and outward movement of the elastomeric member 52 and the respective inner and outer backup members 56*a*, 56*b*, 58*a* and 58*b*.

When the seal system 50 and the anchor assembly 40 are shifted toward the position as shown in FIG. 2, continued pulling on the setting tool 20 will cause the mandrel members 32*a*, 32*b* and 32*c* to move in one direction relative to the seal system pushing against the floating tandem 60 (this actually occurs after the position shown in FIG. 1*c* but before the position shown in FIG. 2) until the shear strength of the shear screw(s) 78 securing the translating cylinder 62 to the mandrel member 32*b* is overcome, and separates.

Referring more specifically to FIGS. 3, 6, 7 and 8, as briefly mentioned above the locking tandem 90 works in conjunction with the rigid-through tandem 30 and the floating tandem 60 to maintain the seal system 50. The locking tandem 90 generally includes a wedging lock ring 92 and a collet lock ring 95, whilst the collet lock ring 95 includes a collet finger 96 a flexible ligament portion 97 and an expanding lock ring segment 98.

The wedging lock ring 92 has a conically profiled outer face 94 and wedging lock ring directional internal teeth 93. The collet finger 96 connects to the flexible ligament portion 97 which connects to the expanding lock ring segment 98. The expanding lock ring segment 98 has outwardly facing ratcheting teeth 99.

The mandrel member 32*b* includes a length of directional external teeth 37. These directional external teeth 37 interact (ride-on and ratchet) with companion wedging lock ring directional internal teeth 93 (see FIGS. 7 & 8). Also, the translating cylinder 62 includes directional internal teeth 79 on the interior of the translating cylinder 62. These directional internal teeth 79 interact (ride-on and ratchet) with companion outwardly facing ratcheting teeth 99 on the expanding lock ring segment 98. The directional external teeth 37 together with the wedging lock ring directional internal teeth 93 are for allowing ratcheting-type one direction (only) motion of the wedging lock ring 92 relative to mandrel member 32*b*. The impetus for this motion comes from the collet lock ring 95 (when collet finger 96 pushes on the lower end of wedging lock ring 92). The impetus for the motion of collet lock ring 95 comes from the ratcheting-type interaction of directional internal teeth 79 with companion outwardly facing teeth 99 as the floating tandem 60 (or cylinder 62) moves toward the elastomeric member 52.

Figure 7:
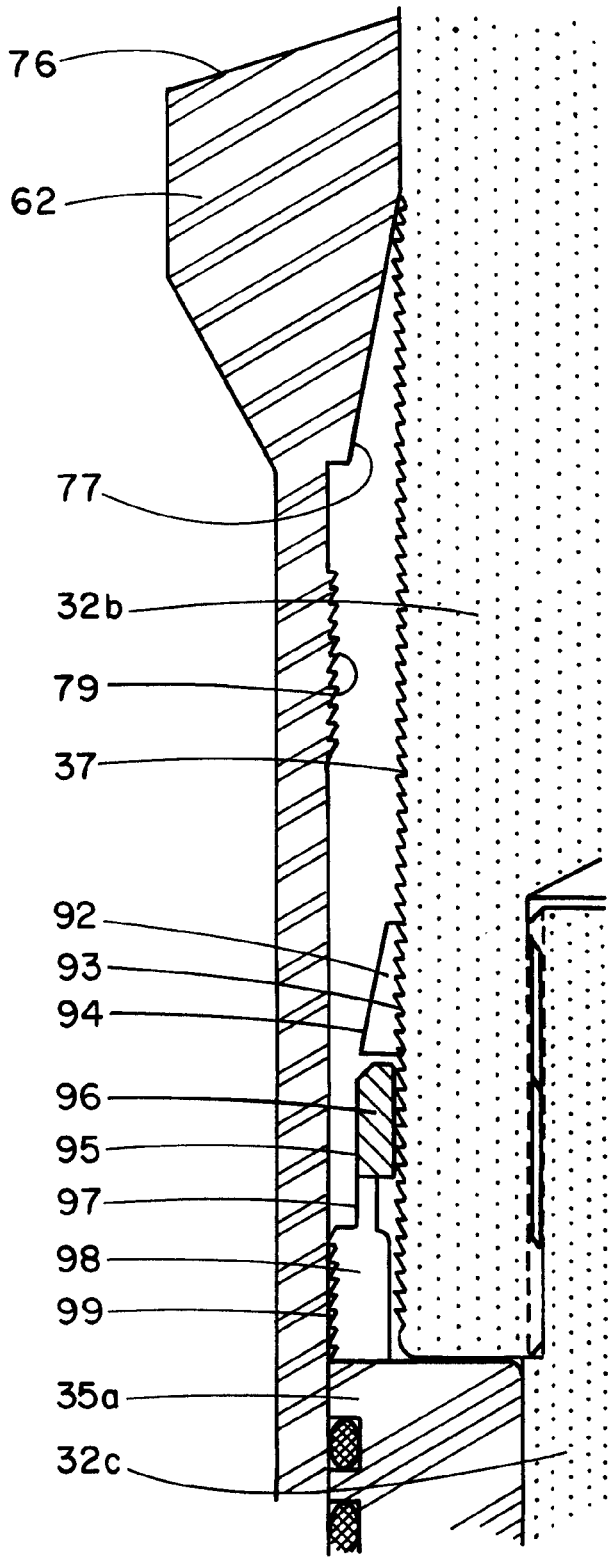
FIG. 7 is an area view from FIG. 1C of the area surrounding the locking tandem 90.
Figure 8:
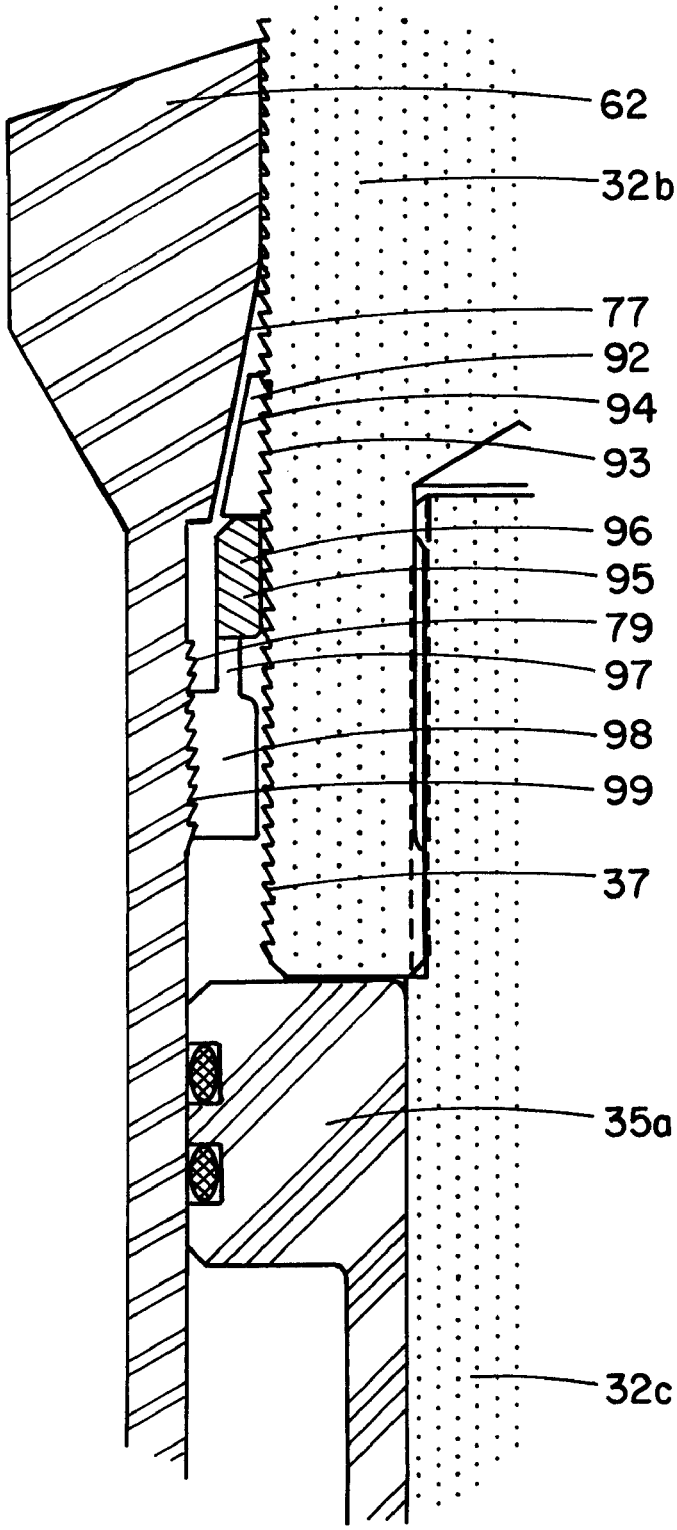
FIG. 8 is an area view from FIG. 3 of the area surrounding the locking tandem 90.

By comparing the position of the tool and remedial system 10 shown in FIG. 7 to FIG. 8, it will be realized that the mandrel members 32*a*, 32*b* and 32*c* must first be pulled or shifted toward the position of FIG. 8 to initiate engagement between directional internal teeth 79 with companion outwardly facing teeth 99 and the "healing" movements of the tool and remedial system 10. Thereafter, during activation of the floating tandem 60, ratcheting teeth 99 will ride on and ratchet along companionly profiled directional internal teeth 79.

The conically profiled outer face 94 is profiled for thrusting of the wedging lock ring 92 into wedging-engagement along a companionly profiled interior wall 77 of the translating cylinder 62. When the wedging lock ring 92 is wedged into the translating cylinder 62 by interface of the walls or surfaces 94 and 77, the hindward motion of the floating tandem 60 will be blocked by the locking tandem 90 whilst the advancing or forward motion of the floating tandem 60 may continue (note that the advancing motion of the floating tandem 60 is translated from pressure defined as ambient well bore pressure at the setting depth of the tool and remedial system 10, as further described below).

The rigid tandem 30 has at its lower end the conventional bull nose 38. The top 38*a* of bull nose 38 will abut a lower face 70*a* on the translating driver 70 upon completion of the initial movement of the rigid tandem 30 relative to the floating tandem 60 to initially set the seal system 50 (FIG. 2).

The floating tandem 60 further includes communication port(s) 82 through the translating cylinder 62 immediately below the translating driver 65. Recall that after the rigid tandem 30 is pulled relative to the floating tandem 60, vacuum chambers 80*a* and 80*b* (or regions of relatively lower pressure) are created. The communication port(s) 82 permit ambient well bore pressure to act upon the bottom of translating driver 65 resulting in a differential pressure relative to vacuum chamber 80*a* to drive the floating tandem 60 toward the seal system 50. The well pressure also acts upon the lower face 70*a* on the translating driver 70 resulting in a differential pressure relative to vacuum chamber 80*b* to further drive the floating tandem 60 toward the seal system 50.

Figure 11:
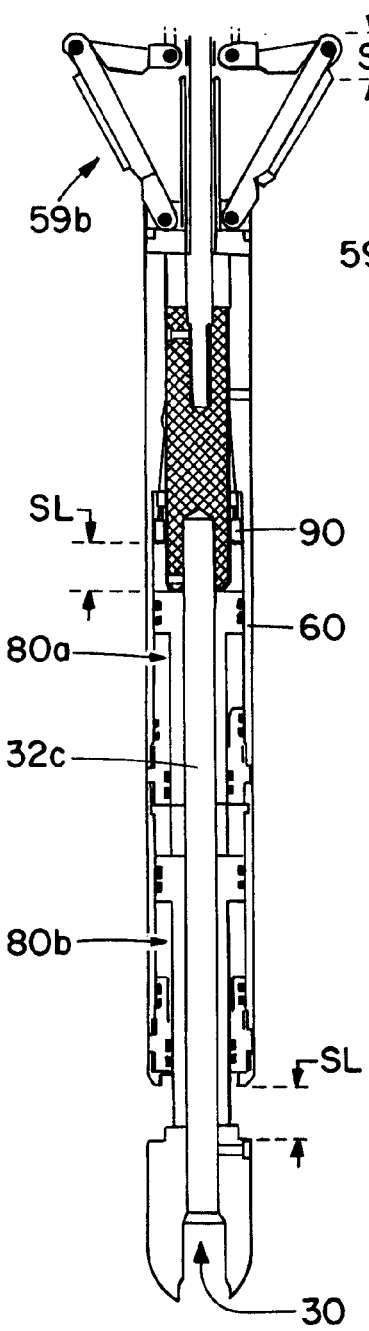
FIG. 11 is a view similar to FIGS. 9 and 10 illustrating the tool and remedial system with the floating tandem and locking tandem activated in response to hydrostatic well pressure at the tool setting depth (at a position similar to FIG. 3).
Figure 10:
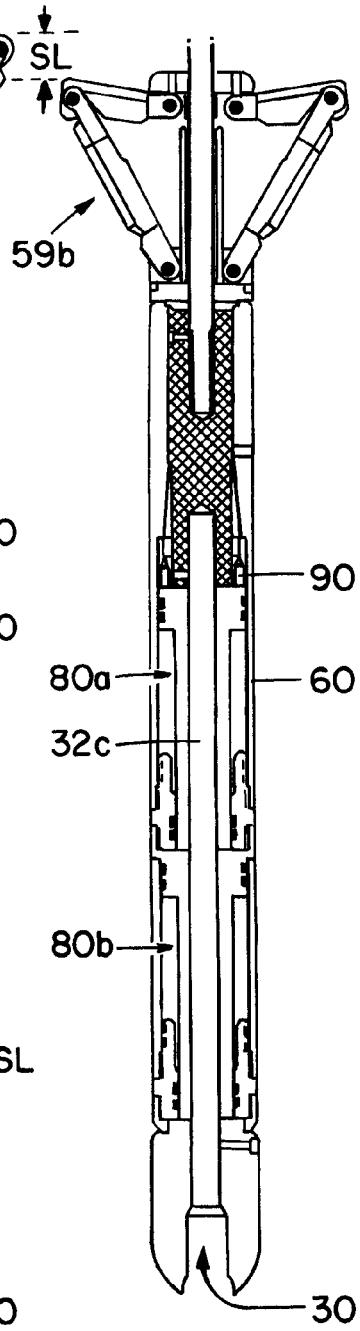
FIG. 10 is a view similar to FIG. 9 only showing the tool and remedial system being set for application of the seal system to a sealing position (at a position similar to FIG. 2).
Figure 9:
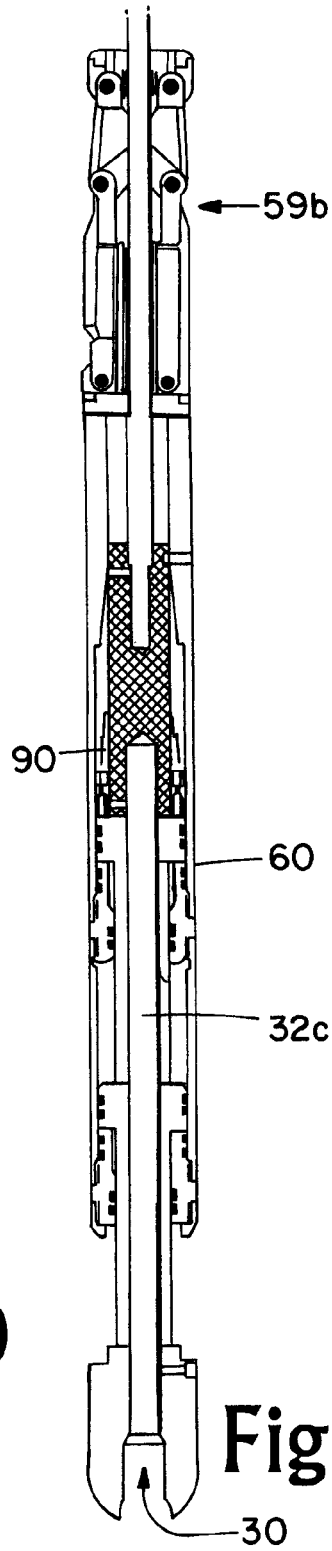
FIG. 9 constitutes a sectional view (below the seal system) of another embodiment of the tool and remedial system as it is run into the well (at a position similar to FIGS. 1A, 1B and 1C).

The parts recited above are replaceable. For example, the number and nature of mandrels 32*a*, 32*b*, and 32*c* may vary depending upon the respective embodiment, and/or the nature of the floating tandem 60 and metallic anti-extrusion envelope system 59*b* may vary (see FIGS. 9-11 which represent an embodiment functionally similar to FIGS. 1-3 as an example in this regard). The number of vacuum chambers 80*a*, 80*b* and translating drivers 70, 75 combinations may vary, whilst having more than one makes the system "multi-stage" for enhancing pressure in a low hydrostatic pressure condition.

EXAMPLE OPERATION

When it is desired to run and set the tool and remedial system 10 within the tubular member 12 of the subterranean well 16, the setting tool 20 is secured at the upper most end of the tool and remedial system 10, as shown in FIG. 1A. Thereafter, the tool and remedial system 10 is introduced into the well 16 on the setting tool 20.

At the desired location for setting of the tool and remedial system 10, the adapter rod 18 of the setting tool 20 is pulled upwardly relative to the stable adaptor sleeve 22. The adapter rod 18 pulls a slip cradle 19 which sets mandrel member 32*a* in motion while adaptor sleeve 22 remains stationary (holding back-up lock ring 41 stationary). Shear pin(s) 17 are for anti-rotation.

Multiple shear screws 49 hold the lower wedging cone 48 in place. Shear screws 49 may, for example, be set to shear at one thousand pounds of shear force. As the settings tool adaptor rod 18 continues to be shifted or pulled upwardly, the lower wedging cone 48 carried on the mandrel member 32*a* will also travel upwardly such that the profiled surface 47*b* will move along the companion profiled lower wedging face 46*b* of the radially bi-directional slips 43 of the anchor assembly 40.

Likewise, the similarly designed upper profiled surface 47*a* will travel along the upper wedging face 46*a*, to move the radially bi-directional slips 43 from the position shown in FIG. 1A to the anchoring position shown in FIG. 2.

The pulling upon the adaptor rod 18 will also cause the mandrel member 32*a*, the mandrel member 32*b* and the mandrel member 32*c* to be carried upwardly. During such movement, the ram surface 76 of the translating cylinder 62 will eventually contact the surface of the lower outer backup member 58*b*.

Continued upward pulling upon the setting tool adaptor of rod 18 and the mandrel members 32*a*, 32*b* and 32*c* will cause shear screws 49 to shear, thereby permitting the mandrel members 32*a*, 32*b* and 32*c* to be moved further, upwardly, after anchoring of the anchor assembly 40. An upper face on the upper outer metal backup member 58*a* contacts the lower wedging cone 48, but because of the anchoring engagement of the anchor assembly 40, the stable lower wedging cone 48 and the upwardly moving translating cylinder 62 will create compression and first cause the elastomeric member 52 to expand outwardly from the initial, run-in position shown in FIG. 1B, to set position shown in FIG. 2. Further travel of the translating cylinder 62 in response to continued upward pulling on the setting tool adaptor rod 18 will compress and drive the upper and lower outer metal backup members 58*a* and 58*b*, and hence, upper and lower inner metal backup members 56*a* and 56*b* into the seal back-up, anti-extrusion position, as shown in FIG. 2 where the elastomeric member 52 is driven against the inner diameter of the tubular member 12 (initially, for example, at 8,000 pounds force). This creates a condition where differing ambient wellbore pressure conditions can exist above and below the seal system 50.

Next, further upward pulling on the setting of tool adaptor rod 18 is translated into the setting mandrel member 32*a*, 32*b* and 32*c* such that continued upward pulling causes the shear strength of the sheer screw(s) 78 to be overcome. Thereafter, the floating tandem 60 is no longer pinned to the rigid tandem 30.

Then, further upward movement of the rigid tandem 30 (by pulling) will create a void or vacuum chambers 80*a* and 80*b* (or regions of relatively lower pressure) as the piston heads 35*a* and 35*b* separate from their respective translating drivers 65 and 70.

When it is desired to remove the setting tool adaptor rod 18 and the mandrel member 32*a* out of the well, additional continued upward pulling upon the adaptor rod 18 will cause the mandrel member 32*a* to shear from mandrel member 32*b* at weak point 36. Then the adopter rod 18 may be removed from the well with the mandrel members 32*a*.

Now, because of the disengagement of the translating cylinder member 62 from the mandrel member 32*c*, hydrostatic well pressure may act through the communication port(s) 82 on the bottom of translating driver 65 and upon the lower face 70*a* on the translating driver 70 (creating a region of relatively higher pressure or differential pressure across this mechanical drive system) such that the translating drivers 65 and 70 in tandem drive the translating cylinder 62 upwardly during the "healing" stroke (that will create a stroke length SL over time), e.g., to compensate for extrusion in the elastomer beyond one or both of the metallic anti-extrusion envelope systems 59*a* and 59*b*.

The locking tandem 90 functions to maintain the compressive force by preventing hindward motion or retreat of the floating tandem 60 while allowing advancement of the floating tandem 60 (together with the locking tandem 90). In the embodiment shown, the locking tandem 90 accomplishes this function by interposing and wedging between the rigid-through tandem 30 and the floating tandem 60 and by allowing motion in only one direction (via ratcheting). As the translating cylinder 62 moves upwardly to further compress and exert pressure upon the upper and lower outer metal backup members 58*a* and 58*b*, and hence, upper and lower inner metal backup members 56*a* and 56*b*, the collet finger 96 urges the wedging lock ring 92 disposed around mandrel member 32*b* to ratchet upwardly until conically profiled outer face 94 on the wedging lock ring 92 comes into companion engagement with the companionly profiled interior wall 77 interior of the translating cylinder 62. The wedging lock ring 92 is uni-directionally locked into position between the interior of the cylinder 62 and the exterior of the mandrel member 32*b* when the collet finger 96 becomes inter-engaged by means of outwardly facing ratcheting teeth 99 on expanding lock ring segment 98 being lockingly inter-engaged with directional internal teeth 79. This position is as shown in FIGS. 2, 3 and 8.

The stroke length or "take-up" distance SL (see FIG. 3 and compare and contrast to FIG. 2) is determined by the relative motion between the floating tandem 60 (which acts to compress the elastomeric member 52) and the rigid tandem 30. The stroke length SL is significant in that it can make-up for extrusion (also deformities, expansion, contraction or washing away of debris at the interior wall 14) of elastomer at upper and lower outer metal backup members 58*a* and 58*b*, and upper and lower inner metal backup members 56*a* and 56*b* to effectuate a continued effective seal of the elastomeric member 52. In a preferred embodiment the stroke length SL will be greater than 0.5 inches and could be up to and beyond four feet. This creates a sealing relationship that can be maintained for greater than eight to twelve hours, eliminating the need for cementing within such timeframes while using expansion ratios up to and beyond 3.4 to one.

Although the invention has been described in terms of specified embodiments which are set forth in detail, it should be understood that this is by illustration only that the invention is not necessarily limited thereto, since alternative embodiments and operating techniques will become apparent to those skilled in the art in view of the disclosure. By way of example, the healing system as shown is operable by mere translation of hydrostatic pressure forces from a bore-hole using differential pressure but could be operable based upon, by way of example but not limited to, pressurized gas contained in cylinders, or a spring system (e.g. disc or coil, not shown). Accordingly, modifications are contemplated which can be made without departing from the spirit of the described invention.

The invention claimed is:

1. An apparatus for maintaining a compression force on an elastomeric member of a downhole tool, comprising:

a piston head and a translating driver defining a chamber wherein the chamber defines a region of relatively low pressure:

wherein the piston head and the translating driver are moved apart upon setting the tool downhole: and wherein a well pressure acts on the translating driver to urge it towards the piston head, thereby maintaining a compression force on the elastomeric member.

2. The apparatus according to claim 1, wherein the elastomeric member of the downhole tool is radially expanded outwardly engaging a wall of a wellbore for setting the tool downhole.

3. The apparatus according to claim 2, further comprising a means for preventing hindward motion interposed with the piston head and the translating driver.

4. The apparatus according to claim 3, wherein said means for preventing hindward motion comprises a locking tandem.

5. The apparatus according to claim 4, wherein said locking tandem comprises a wedging lock ring; and a collet lock ring mounted contiguous with said wedging lock ring.

6. A method including providing a tool having an elastomeric member, and running the tool into a wellbore, comprising the steps of:

activating the elastomeric member into a set position while the tool is in the wellbore whereby the elastomeric member is engaging a wall of the wellbore; and creating a region of relatively low pressure within a chamber defined by a piston head and a translating driver by moving one of the piston head and the translating driver away from the other while the tool is in the wellbore.

7. The method according to claim 6, wherein well pressure within the wellbore is acting on the translating driver for urging the translating driver towards the piston head.

8. The method according to claim 7, wherein said step of activating the elastomeric member into the set position while the tool is in the wellbore whereby the elastomeric member is engaging the wall of the wellbore further comprises:

compressing the elastomeric member and expanding the elastomeric member radially for engaging the wall of the wellbore for setting the tool downhole.

9. The method according to claim 8, wherein said step of compressing the elastomeric member and expanding the elastomeric member radially occurs prior to said step of moving one of the piston head and the translating driver away from the other.

10. An apparatus for maintaining a compression force on an elastomeric member of a downhole tool, comprising:

a piston head and a translating driver defining a chamber having a first volume; and wherein the piston head and the translating driver are moved apart upon setting the tool downhole wherein the chamber increases to a second volume larger than the first volume thereby defining a region of relatively low pressure.

11. The apparatus according to claim 10, wherein a well pressure acts on the translating driver to urge it towards the piston head, thereby maintaining a compression force on the elastomeric member.

12. The apparatus according to claim 11, wherein the elastomeric member of the downhole tool is radially expanded outwardly engaging a wall of a wellbore for setting the tool downhole.

13. The apparatus according to claim 12, further comprising a means for preventing hindward motion interposed with the piston head and the translating driver.

14. The apparatus according to claim 13, wherein said means for preventing hindward motion comprises a locking tandem.

15. The apparatus according to claim 14, wherein said locking tandem comprises a wedging lock ring; and a collet lock ring mounted contiguous with said wedging lock ring.

* * * * *